US012595919B2

(12) United States Patent
Kanagaraj et al.

(10) Patent No.: US 12,595,919 B2
(45) Date of Patent: Apr. 7, 2026

(54) FILTRATION OF HVAC SYSTEM FOR IMPROVED INDOOR AIR QUALITY

(71) Applicant: Carrier Corporation, Palm Beach Gardens, FL (US)

(72) Inventors: Arun Dev Kanagaraj, Dindigul (IN); Alex Raj Arulanandan, Coonoor (IN); Manoj Kumar Sahoo, Rourkela (IN); Yusuf Ali Ahamed Yacoob, Madurai (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 364 days.

(21) Appl. No.: 18/310,803

(22) Filed: May 2, 2023

(65) Prior Publication Data

US 2023/0358420 A1 Nov. 9, 2023

Related U.S. Application Data

(60) Provisional application No. 63/339,054, filed on May 6, 2022.

(51) Int. Cl.

| | |
|---|---|
| ***F24F 3/16*** | (2021.01) |
| ***F24F 11/63*** | (2018.01) |
| ***F24F 11/77*** | (2018.01) |
| ***F24F 110/50*** | (2018.01) |

(52) U.S. Cl.

CPC ..... *F24F 3/16* (2013.01); *F24F 11/63* (2018.01); *F24F 11/77* (2018.01); *F24F 2110/50* (2018.01)

(58) Field of Classification Search

CPC ..... F24F 3/16; F24F 8/20

See application file for complete search history.

(56) References Cited

U.S. PATENT DOCUMENTS

| | | | | |
|---|---|---|---|---|
| 11,269,306 | B2 | 3/2022 | Risbeck et al. | |
| 11,446,600 | B2 * | 9/2022 | Hourani | F24F 3/16 |
| 11,649,977 | B2 * | 5/2023 | He | F24F 11/63 700/276 |
| 2014/0260692 | A1 | 9/2014 | Sharp | |
| 2019/0346170 | A1 | 11/2019 | Benefield | |

(Continued)

OTHER PUBLICATIONS

Extended European Search Report for European Application No. 23171960.0; Report Mail Date Sep. 27, 2023 (8 Pages).

(Continued)

*Primary Examiner* — Allen R. B. Schult

(74) *Attorney, Agent, or Firm* — CANTOR COLBURN LLP

(57) ABSTRACT

A heating ventilation and air conditioning (HVAC) system includes an air handling unit having an air handling unit outlet, and at least one zone having an inlet and an outlet. The at least one zone is operably coupled to the air handling unit outlet. A return air duct fluidly connecting the outlet to the air handling unit and at least one sterilization system arranged within the return air duct at or directly downstream from the outlet. At least one indoor air quality sensor operable to monitor an indoor air quality within the at least one zone. A controller is operably coupled to the at least one indoor air quality sensor and the at least one sterilization system. The controller is configured to operate the at least one sterilization system when the indoor air quality within the at least one zone exceeds an allowable threshold.

18 Claims, 2 Drawing Sheets

(56) References Cited

U.S. PATENT DOCUMENTS

| | | | |
|---|---|---|---|
| 2021/0010693 | A1 | 1/2021 | Gamroth et al. |
| 2022/0042694 | A1 | 2/2022 | He et al. |

OTHER PUBLICATIONS

Carrier "Air Conditioners, HVAC Education, Efficiency, Maintenance, Home Comfort, Indoor Air Quality-Electronic Air Filter" Homeowner Resources https://www.carrier.com/residential/en/us/homeowner-resources/hvac-glossary/electronic-air-filter/ (2023) 2 pages.

* cited by examiner

FILTRATION OF HVAC SYSTEM FOR IMPROVED INDOOR AIR QUALITY

CROSS-REFERENCE TO RELATED APPLICATIONS

This application claims the benefit of U.S. Application No. 63/339,054, filed May 6, 2022, the contents of which are incorporated by reference herein in their entirety.

BACKGROUND

Exemplary embodiments of the present disclosure relate to a heating ventilation and air conditioning (HVAC) system, and more particularly, to a method for controlling operation of one or more components of the HVAC system in response to the sensed indoor air quality of an area to be conditioned by the HVAC system.

In a typical climate control system of a building, such as a heating ventilation and air conditioning (HVAC) system, a thermostat controls the temperature of an area to be conditioned within the building. A building central heating/cooling unit forces heated or cooled air to various points in the building through duct work. The temperature is therefore controlled by varying the airflow delivered to the area to be conditioned. Control of the system may filthier be dependent on a manually assigned occupancy schedule. Accordingly, the existing control strategy does not always control the building indoor air quality (IAQ) at a desired state, and the HVAC energy use might be wasted.

BRIEF DESCRIPTION

According to an embodiment, a heating ventilation and air conditioning (HVAC) system includes an air handling unit having an air handling unit outlet, and at least one zone having an inlet and an outlet. The at least one zone is operably coupled to the air handling unit outlet. A return air duct fluidly connecting the outlet of the at least one zone to the air handling unit and at least one sterilization system arranged within the return air duct at or directly downstream from the outlet of the at least one zone. At least one indoor air quality sensor operable to monitor an indoor air quality within the at least one zone. A controller is operably coupled to the at least one indoor air quality sensor and the at least one sterilization system. The controller is configured to operate the at least one sterilization system when the indoor air quality within the at least one zone exceeds an allowable threshold.

In addition to one or more of the features described above, or as an alternative to any of the foregoing embodiments the at least one sterilization system further comprises an electronic filter.

In addition to one or more of the features described above, or as an alternative to any of the foregoing embodiments the at least one sterilization system further comprises an ultraviolet (UV) light.

In addition to one or more of the features described above, or as an alternative to any of the foregoing embodiments the at least one zone includes a plurality of zones, and the at least one indoor air quality sensor includes a plurality of indoor air quality sensors, wherein the at least one indoor air quality sensor is arranged within each of the plurality of zones.

In addition to one or more of the features described above, or as an alternative to any of the foregoing embodiments the at least one sterilization system includes a plurality of sterilization system, each of the plurality of sterilization systems being associated with a corresponding zone of the plurality of zones.

In addition to one or more of the features described above, or as an alternative to any of the foregoing embodiments the controller is further configured to operate the HVAC system in one of a first filtration mode and a second filtration mode to reduce contaminants associated with the indoor air quality within the at least one zone to below the allowable threshold.

In addition to one or more of the features described above, or as an alternative to any of the foregoing embodiments the HVAC system is operable in the first filtration mode when the indoor air quality in a single zone of the plurality of zones exceeds the allowable threshold.

In addition to one or more of the features described above, or as an alternative to any of the foregoing embodiments the HVAC system is operable in the first filtration mode when the indoor air quality in several zones of the plurality of zones exceeds the allowable threshold, the several zones being less than 40% of the plurality of zones.

In addition to one or more of the features described above, or as an alternative to any of the foregoing embodiments the HVAC system is operable in the second filtration mode when the indoor air quality in more than one of the plurality of zones exceeds the allowable threshold.

In addition to one or more of the features described above, or as an alternative to any of the foregoing embodiments the HVAC system is operable in the second filtration mode when the indoor air quality in several zones of the plurality of zones exceeds the allowable threshold, the several zones being less more 40% of the plurality of zones.

In addition to one or more of the features described above, or as an alternative to any of the foregoing embodiments comprising at least one electronic filter or ultraviolet light arranged within the air handling unit.

In addition to one or more of the features described above, or as an alternative to any of the foregoing embodiments the at least one electronic filter or the ultraviolet light is energized when the HVAC system is in the second filtration mode.

According to an embodiment, a method of operating a heating, ventilation, and air conditioning (HVAC) system includes detecting an indoor air quality within a plurality of zones of the HVAC system, determining that the indoor air quality within at least one zone of the plurality of zones exceeds an allowable threshold, and initiating operating of the HVAC system in one of a first filtration mode and a second filtration mode. Operation in both the first filtration mode and the second filtration mode includes energizing a sterilization system associated with the at least one zone.

In addition to one or more of the features described above, or as an alternative to any of the foregoing embodiments operating the HVAC system in the first filtration mode further comprises adjusting a position of an outside air damper of an air handling unit.

In addition to one or more of the features described above, or as an alternative to any of the foregoing embodiments operating the HVAC system in the second filtration mode further comprises fully opening an outside air damper of an air handling unit and increasing a speed of a fan of the air handling unit.

In addition to one or more of the features described above, or as an alternative to any of the foregoing embodiments operating the HVAC system in the second filtration mode further comprises energizing at least one of an electronic filter and an ultraviolet light arranged within the air handling unit.

In addition to one or more of the features described above, or as an alternative to any of the foregoing embodiments initiating operating of the HVAC system in the first filtration mode occurs in response to determining that the indoor air quality within a single zone of the plurality of zones exceeds the allowable threshold.

In addition to one or more of the features described above, or as an alternative to any of the foregoing embodiment initiating operating of the HVAC system in the first filtration mode occurs in response to determining that the indoor air quality within several zones of the plurality of zones exceeds the allowable threshold, the several zones being less than 40% of the plurality of zones.

In addition to one or more of the features described above, or as an alternative to any of the foregoing embodiments initiating operating of the HVAC system in the second filtration mode occurs in response to determining that the indoor air quality within more than one of the plurality of zones exceeds the allowable threshold.

In addition to one or more of the features described above, or as an alternative to any of the foregoing embodiments operating of the HVAC system in the second filtration mode occurs in response to determining that the indoor air quality within several zones of the plurality of zones exceeds the allowable threshold, the several zones being less more 40% of the plurality of zones.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
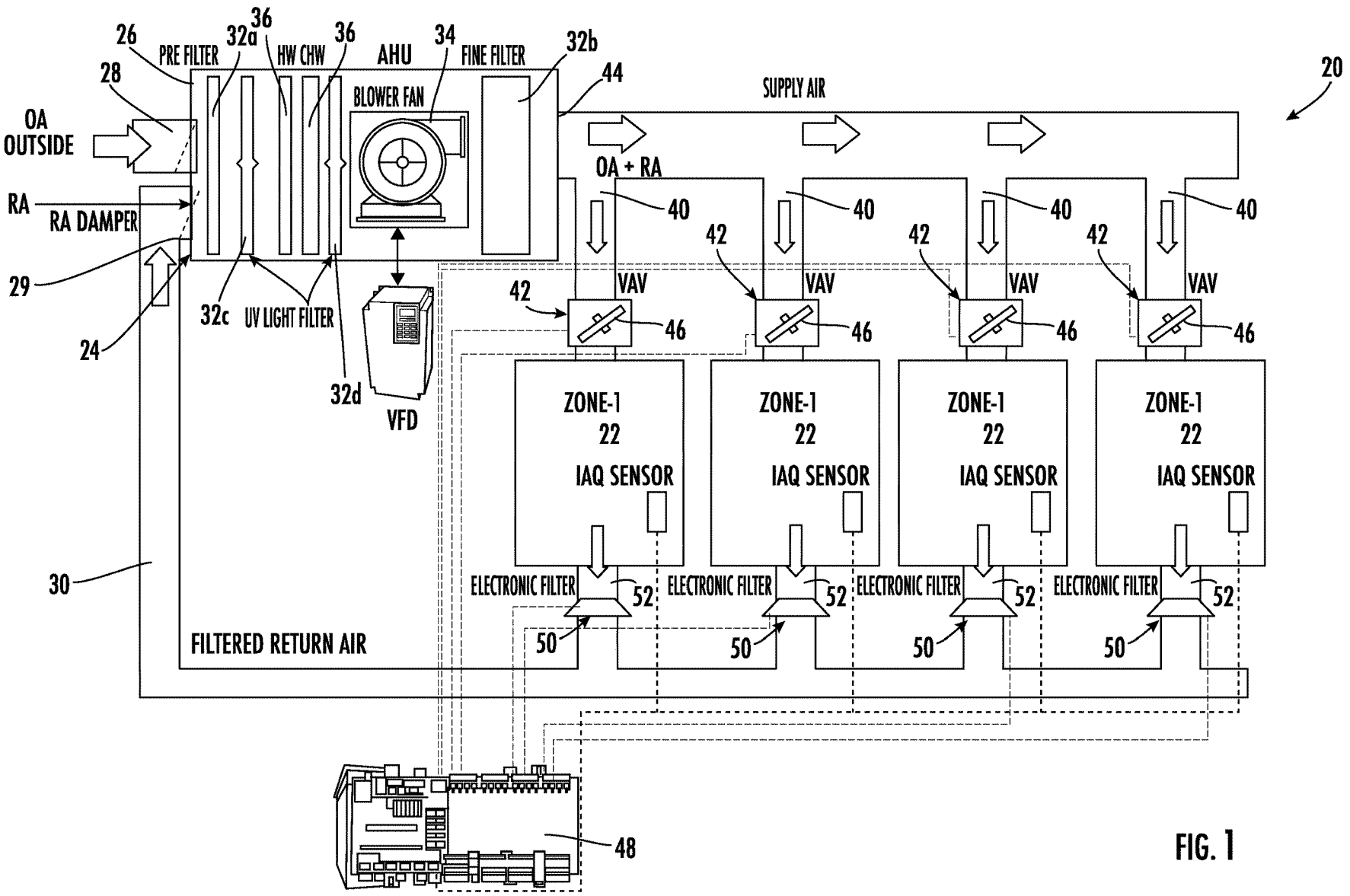
FIG. 1 is a schematic diagram of a portion of a heating, ventilation, and air conditioning system according to an embodiment.

With reference now to FIG. 1, an example of a heating ventilation and air conditioning (HVAC) system 20, such as a variable air volume or dedicated outdoor air multizone system, is illustrated. In its simplest form, the HVAC system 20 uses a variable airflow having a constant temperature to heat and cool an area to be conditioned. Although the illustrated HVAC system 20 includes four distinct zones 22 or areas to be conditioned, it should be understood that an HVAC system 20 having any number of zones 22, including a single zone, two zones, three zones, or at least five zones is also within the scope of the disclosure.

The HVAC system 20 is made up of one of an air handling unit, a rooftop unit, illustrated schematically at 24, such as roof top unit for example. The air handling unit 24 includes a mixing box 26 configured to receive a supply of outside air OA via operation of an outside air damper 28. In some embodiments, the mixing box 26 may alternatively or additionally be configured to receive a supply of return air RA from one or more of the zones 22 of the HVAC system 20, such as via return air damper 29 coupled to a return air duct 30 extending between the at least one zone 22 and the air handling unit 24 for example. The outside air OA or mixture of outside air and return air (OA+RA) is configured to pass through one or more filters 32. In the illustrated, non-limiting embodiment, the at least one filter includes a plurality of filters arranged in series relative to the air flow, such as a first pre-filter 32*a*, a second fine filter 32*b*, the fine filter having a reduced opening size relative to the pre-filter. In an embodiment, at least one electronic or ultraviolet (UV) light filters 32*c*, 32*d* are disposed between pre-filter 32*a* and the fine filter 34*b*. In embodiments where at least one of the filters is a UV light filter, the light emitted at the UV light filters 32*c*, 32*d* has a wavelength between 207 nm and 222 nm and is configured to sterilize the air. However, in other embodiments, a UV light source 32*c*, 32*d* may be mounted adjacent to each of the pre-filter 32*a* and the fine filter 32*b*, respectively.

A fan 34, such as a variable speed fan for example, is configured to supply air to one or more coil units 36 located downstream from at least one filter of the plurality of filters 32*a*-32*d* in amounts determined by the speed of the fan 34. Although the fan 34 is shown as being located downstream from the coil unit 36, and therefore has a draw-through configuration, it should be understood that embodiments where the fan 34 is arranged at another located and/or has a blow-through configuration are also within the scope of the disclosure.

One or more supply ducts 40 extend from and couple an outlet of the air handling unit 24 to the plurality of zones 22 of the HVAC system 20. In the illustrated, non-limiting embodiment, each of the mixing box 26, one or more filters 32, coil unit 36, and fan 34 is illustrated and described herein as being arranged within the air handling unit 24 such that air output therefrom has been conditioned for delivery to one or more zones 22. However, in other embodiments, one or more of the mixing box 26, one or more filters 32, at least one coil unit 36, and fan 34 may be located remotely from the air handling unit 24, such as within a portion of the supply, duct 40 located downstream from the air handling unit 24 for example.

A separate terminal unit 42 is operably coupled to each of the plurality of supply ducts 40 downstream from an air handling unit outlet 44 and upstream from a respective zone 22. Accordingly, the terminal unit 42 is a flow control device provided at the individual zone level, and therefore is configured to control the flow rate of the airflow provided from the mixing box 26 to a respective zone 22. In an embodiment, such as when the HVAC system is a VAV system, the terminal unit 42 includes a terminal box having an air damper and an actuator, represented in combination at 46, the actuator being operable to adjust a position of the air damper 46 to control the air flow through the air damper 46 into the zone 22. In other embodiments the terminal unit 42 includes a fan coil unit having a fan located therein to drive a flow of air to an adjacent zone 22. A terminal unit 42 having any suitable construction for controlling a flow into a zone 22 is contemplated herein.

One or more sensors are arranged throughout the HVAC system 20 including within each respective zone 22 of the HVAC system 20. In the illustrated, non-limiting embodiment, the one or more sensors include at least one sensor operable to monitor a parameter associated with the indoor air quality (IAQ). In an embodiment, the at least one indoor air quality sensor (IAQ sensor), is operable to detect the level or amount of one or more contaminants, including, but not limited to carbon dioxide, volatile organic compounds, and particulate matter for example. The HVAC system 20 may include a plurality of indoor air quality sensor arranged at different locations within the system 20, such as within each zone 22, within the supply duct 40, and/or upstream from or at the outside air damper. In an embodiment, a separate sensor may be provided for each separate contaminant to be monitored. However, embodiments where a single IAQ sensor is operable to measure a plurality of contaminants, or alternatively, a contaminant and another operating parameter is also within the scope of the disclosure. Each of the sensors described herein may be operable to continuously monitor the environment, or may measure the environment at intervals, such as less than or equal to every minute for example.

Operation of the HVAC system 20 is controlled by a controller 48 operably coupled to each of the plurality of sensors, outside air damper 28, fan 34, and the actuator of each respective terminal unit 42. The controller 48 may include one or more or a microprocessor, microcontroller, application specific integrated circuit (ASIC), or any other form of electronic controller known in the art. The controller 48 may be part of the HVAC system 20, or alternatively, may be part of a building control system for a building having at least one area to be conditioned by the HVAC system 20. In embodiments where the controller 48 is an integral part of the HVAC system 20, the controller 48 may be configured to communicate directly with a controller of a building control system, or alternatively, may be configured to deposit and access data, such as one or more algorithms or programs for example, stored on the cloud.

With continued reference to FIG. 1, the HVAC system 20 may have a separate sterilization system 50 associated with each zone 22 and operably coupled to the controller 48. Accordingly, embodiments of the HVAC system including a plurality of zones additionally include a plurality of sterilization systems. In the illustrated, non-limiting embodiment, the at least one sterilization system 50 is mounted at or directly downstream from an outlet 52 of the zone 22, such as at a location upstream from a portion of the return air duct 30 where the air from the plurality of zones 22 is configured to merge. In an embodiment, the sterilization system 50 includes an electronic filter, such as a filter that uses electricity to ionize particles passing therethrough. Alternatively, or in addition to the electronic filter, the sterilization system 50 includes a UV light source.

The HVAC system 20 may be configured operable in various modes based on the measured level of one or more contaminants. For example, in a first, normal mode of operation, the level of each of the contaminants measured by the IAQ sensor in each respective zone is less than or equal to a respective allowable threshold associated with an acceptable level of each of the contaminants. In the first, normal mode of operation, the air flow provided to each of the zones 22 is selected to meet or maintain the temperature demand of the zone 22. Further, the sterilization system 50 associated with each zone 22 is not operational during the normal mode.

In a second mode, also referred to herein as a first filtration mode, operation of one or more of the sterilization systems 50 is initiated. For example, when the level of one or more of the contaminants being measured by the IAQ sensor within a respective zone is elevated and exceeds a predefined IAQ threshold, the corresponding sterilization system is energized. By turning on the sterilization system, the return air exhausted from the zone 22 to the return air duct 30 is filtered and purified via the electronic filter and/or the UV light. Further, in the second mode, the controller 48 may adjust the position of the outside air damper 28 to increase the flow of outside air provided to the mixing box 26 of the AHU 24. The HVAC system 20 may remain in this second mode until the monitored level of each of the contaminants measured by the IAQ sensor in the zone is less than or equal to a respective allowable threshold. It should be understood that since the first mode of operation is implemented at a zone 22, in embodiments where the HVAC system 20 has a plurality of zones, one of the zones 22 may be operating in the first filtration mode while another of the zones 22 may be operating in a normal mode.

In a third mode of operation, also referred to herein as an enhanced or second filtration mode, in addition to operation of one or more of the sterilization systems 50 associated with zones having an elevated IAQ, additional measures are taken to dilute the one or more contaminants within the airflow. In an embodiment, this dilution is performed via the controller 48, such as by changing the position of the air damper 46 within one or more of the terminal units 42 operably coupled to one or more of the zones 22. In an embodiment, the controller 48 will open the air damper to maximize the airflow provided to one or more zones 22, and in some embodiments to each of the zones 22, regardless of whether the IAQ within that zone 22 is above the IAQ threshold.

In response to operation in the third mode, the controller 48 may be configured to open the outside air damper 28 to increase, and in some embodiments maximize, the flow of outside air OA into the HVAC system 20, such as into the air handling unit 24 for example. Alternatively, or in addition, the controller 48 may adjust, such as increase for example, the speed of the fan 34. Further, the electronic filters or the UV filters or UV lights 32*c* and 32*d* mounted within the flow path defined through the AHU 24 are energized to further clean and sterilize the outdoor air being drawn into the system 20.

Figure 2:
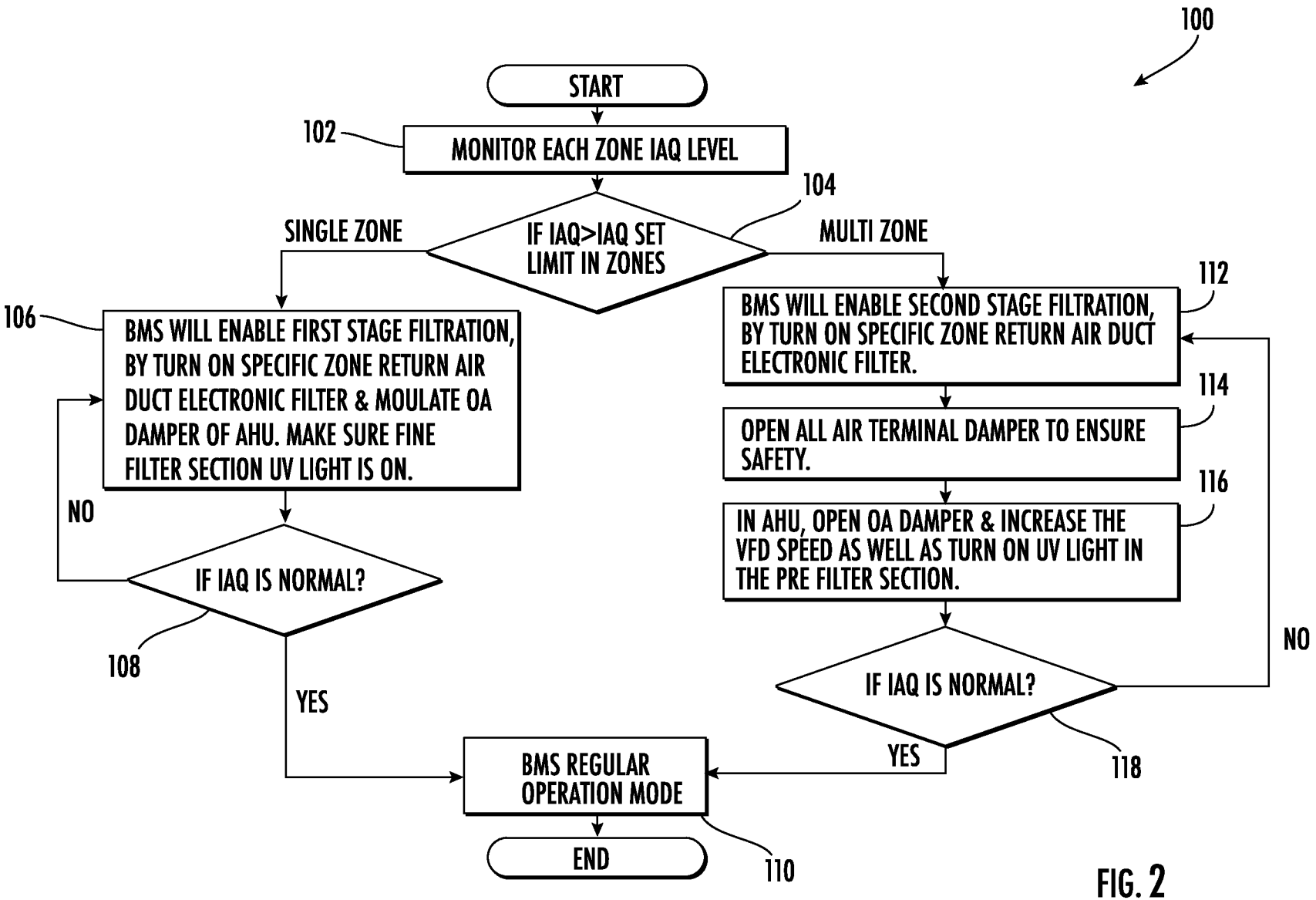
FIG. 2 is a flow diagram of a method of operation a heating, ventilation, and air conditioning system according to an embodiment.

With continued reference to FIG. 1, and further reference to FIG. 2, a method 100 of operating of the HVAC system 20 is illustrated in more detail. As shown, in block 102, the indoor air quality within each of the zones 22 is monitored continuously or intermittently by a respective IAQ sensor. These measured IAQ values are communicated to the controller 48 and the controller 48 is configured to compare each sensed IAQ value with a respective IAQ threshold corresponding to that zone 22 (see block 104). It should be understood that the IAQ threshold associated with different zones 22 may be the same or may be different. Upon determining that a single zone 22 of the plurality of zones has an elevated IAQ exceeding a corresponding IAQ threshold, the HVAC system 20 will transform to operation in the first filtration mode. As previously described, and as shown in block 106, operation in the first filtration mode includes energizing the sterilization system 50 associated with identified zone 22, also referred to herein as a contaminated zone. Operation in the first mode further includes adjusting a position of the outside air damper 28. In an embodiment, operation in the first filtration mode includes energizing the electronic filter, UV filter or UV light source 32*d* positioned closest to the fine filter 32*b*. Operation in the first filtration mode will generally continue until the measured IAQ associated with the contaminated zone 22 has fallen below the corresponding IAQ threshold, see block 108. Once below the IAQ threshold, the HVAC system 20 will return to normal operation, as shown in block 110.

It should be understood that although operation in the first mode is described herein as being initiated when the measured IAQ of only a single zone of the plurality of zones exceeds a corresponding IAQ threshold, in other embodiments, the HVAC system 20 is configured to operate in a first mode when multiple zones 22 have an elevated IAQ exceeding a corresponding threshold. In such embodiments, the total number of contaminated zones must be less than a predetermined zone threshold. For example, in the first mode the number of contaminated zones must be less than or equal to 50% of the total number of zones, or in some embodiments, less than or equal to 40%, 35%, 30%, or 25% of the total number of zones 22. Accordingly, in embodiments where the number of contaminated zones exceeds the predetermined percentage, such as when more than 40% of the zones are contaminated for example, the HVAC system 20 will operate in the second filtration mode.

Upon determining that several zones of the plurality of zones 22 have an elevated IAQ exceeding a corresponding IAQ threshold, the HVAC system 20 will transform to a second filtration mode. As described above, operation in the second filtration mode includes energizing the sterilization system 50 associated each of the with contaminated zones (see block 112). Further, the controller 48 may be operable to fully open the air dampers 46 within the terminal units 42 fluidly connected to the contaminated zones 22, as shown in block 114, and may be operable to fully open the outside air damper 28, increase the speed of the fan 34 and energize the electronic filter, UV filters or UV light 32*c* positioned closest to the pre-filter 32*a*, as shown in block 116. Operation in the second filtration mode will generally continue until the measured IAQ associated with each of the contaminated zones has fallen below a corresponding IAQ threshold, see block 118. However, in other embodiments, once the total number of contaminated zones has fallen below the threshold associated with operation in the first filtration mode, the HVAC system 20 may transition to the first filtration mode. Once the IAQ within each of the zones 22 is below an IAQ threshold, the HVAC system 20 will return to normal operation, as shown in block 110.

An HVAC system 20 as described herein has improved indoor air quality compared to existing HVAC systems while still utilizing return air.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heating ventilation and air conditioning (HVAC) system comprising:

an air handling unit having an air handling unit outlet;

at least one zone having an inlet and an outlet, the at least one zone being operably coupled to the air handling unit outlet;

a return air duct fluidly connecting the outlet of the at least one zone to the air handling unit;

at least one sterilization system arranged within the return air duct at or directly downstream from the outlet of the at least one zone;

at least one of an electronic filter and an ultraviolet light device arranged within the air handling unit, within a fluid flow path extending through the air handling unit;

at least one indoor air quality sensor operable to monitor an indoor air quality within the at least one zone; and a controller operably coupled to the at least one indoor air quality sensor, the at least one sterilization system, and the at least one of an electronic filter and an ultraviolet light device;

wherein the controller is configured to operate the HVAC system in a first filtration mode when the indoor air quality within the at least one zone exceeds an allowable threshold, wherein in the first filtration mode, the controller is configured to operate the at least one sterilization system, and in a second filtration mode the controller is configured to operate the at least one of an electronic filter and an ultraviolet light device arranged within the air handling unit, wherein an air flow output from a zone of the HVAC system is sterilized within the at least one sterilization system and within the at least one of the electronic filter and the ultraviolet light device arranged within the air handling unit in series.

2. The HVAC system of claim 1, wherein the at least one sterilization system further comprises an electronic filter.

3. The HVAC system of claim 1, wherein the at least one sterilization system further comprises an ultraviolet (UV) light.

4. The HVAC system of claim 1, wherein the at least one zone includes a plurality of zones, and the at least one indoor air quality sensor includes a plurality of indoor air quality sensors, wherein the at least one indoor air quality sensor is arranged within each of the plurality of zones.

5. The HVAC system of claim 4, wherein the at least one sterilization system includes a plurality of sterilization system, each of the plurality of sterilization systems being associated with a corresponding zone of the plurality of zones.

6. The HVAC system of claim 5, wherein the controller is further configured to operate the HVAC system in one of a first filtration mode and a second filtration mode to reduce contaminants associated with the indoor air quality within the at least one zone to below the allowable threshold.

7. The HVAC system of claim 6, wherein the HVAC system is operable in the first filtration mode when the indoor air quality in a single zone of the plurality of zones exceeds the allowable threshold.

8. The HVAC system of claim 6, wherein the HVAC system is operable in the first filtration mode when the indoor air quality in several zones of the plurality of zones exceeds the allowable threshold, the several zones being less than 40% of the plurality of zones.

9. The HVAC system of claim 6, wherein the HVAC system is operable in the second filtration mode when the indoor air quality in more than one of the plurality of zones exceeds the allowable threshold.

10. The HVAC system of claim 6, wherein the HVAC system is operable in the second filtration mode when the indoor air quality in several zones of the plurality of zones exceeds the allowable threshold, the several zones less more than 40% of the plurality of zones.

11. A method of operating a heating, ventilation, and air conditioning (HVAC) system comprising:

providing a plurality of zones of the HVAC system and a plurality of sterilization systems, each of the plurality of sterilization systems being associated with a corresponding zone of the plurality of zones;

detecting an indoor air quality within the plurality of zones;

determining that the indoor air quality within at least one zone of the plurality of zones exceeds an allowable threshold; and initiating operating of the HVAC system in one of a first filtration mode and a second filtration mode, wherein operation in both the first filtration mode and the second filtration mode includes energizing the sterilization system of the plurality of sterilization systems associated with the at least one zone.

12. The method of claim 11, wherein operating the HVAC system in the first filtration mode further comprises adjusting a position of an outside air damper of an air handling unit.

13. The method of claim 11, wherein operating the HVAC system in the second filtration mode further comprises fully opening an outside air damper of an air handling unit and increasing a speed of a fan of the air handling unit.

14. The method of claim 13, wherein operating the HVAC system in the second filtration mode further comprises energizing at least one of an electronic filter and an ultraviolet light arranged within the air handling unit.

15. The method of claim 11, wherein initiating operating of the HVAC system in the first filtration mode occurs in response to determining that the indoor air quality within a single zone of the plurality of zones exceeds the allowable threshold.

16. The method of claim 11, wherein initiating operating of the HVAC system in the first filtration mode occurs in response to determining that the indoor air quality within several zones of the plurality of zones exceeds the allowable threshold, the several zones being less than 40% of the plurality of zones.

17. The method of claim 11, wherein initiating operating of the HVAC system in the second filtration mode occurs in response to determining that the indoor air quality within more than one of the plurality of zones exceeds the allowable threshold.

18. The method of claim 11, wherein operating of the HVAC system in the second filtration mode occurs in response to determining that the indoor air quality within several zones of the plurality of zones exceeds the allowable threshold, the several zones being more than 40% of the plurality of zones.

* * * * *